US005209278A

United States Patent [19]

Carpenter et al.

[11] Patent Number: 5,209,278

[45] Date of Patent: May 11, 1993

[54] DRUM CHIPPER WITH KNIFE AND KNIFE HOLDER

[75] Inventors: Charles T. Carpenter; Robert M. Bayly, both of Lake Oswego, Oreg.

[73] Assignee: Commerical Knife,Inc., Wilsonville, Oreg.

[21] Appl. No.: 842,613

[22] Filed: Feb. 27, 1992

[51] Int. Cl.[5] ..... B26D 1/12; B27G 13/04; B02C 18/18

[52] U.S. Cl. ..... 144/230; 144/162 R; 144/174; 144/241; 241/101.7; 241/92; 241/185.5

[58] Field of Search ..... 241/186, 294, 101.7, 241/92; 407/36, 37, 38, 39, 44, 45, 49, 41; 144/162 R, 172, 174, 230, 241

[56] References Cited

U.S. PATENT DOCUMENTS

| | | | |
|---|---|---|---|
| 2,420,057 | 5/1947 | Steffes | 407/41 |
| 3,270,968 | 9/1966 | Hess et al. | 144/230 |
| 3,542,302 | 11/1970 | Salzmann, Jr. | 144/176 |
| 3,739,442 | 6/1973 | Lovendahl | 407/37 |
| 3,776,289 | 12/1973 | Boboltz et al. | 144/230 |
| 3,854,511 | 12/1974 | Maier | 144/230 |
| 3,882,582 | 5/1975 | Williams | 407/37 |
| 4,194,545 | 3/1980 | Kostermeier | 144/230 |
| 4,305,440 | 12/1981 | Lacasse | 407/45 |
| 4,449,556 | 5/1984 | Colton | 144/230 |
| 4,784,337 | 11/1988 | Nettles et al. | 144/241 |

*Primary Examiner*—W. Donald Bray
*Attorney, Agent, or Firm*—Kolisch Hartwell Dickinson McCormack & Heuser

[57] ABSTRACT

A drum chipper having a rotatable, power-driven drum supporting a knife. With rotation of the drum, a cutting edge in the knife is moved past a cutter bar. A knife mounting keyed to the knife is adjustably positioned along a path in the drum to position the knife. The knife is a double-edged knife, with one edge replacing the other with dulling of the latter edge.

5 Claims, 2 Drawing Sheets

DRUM CHIPPER WITH KNIFE AND KNIFE HOLDER

BACKGROUND AND SUMMARY OF THE INVENTION

This invention relates to chipper apparatus, and more particularly to what is referred to herein as a drum-type chipper, which includes a power-driven rotatable drum, and multiple blades or knives distributed about the periphery of the drum for cutting material into chips with rotation of the drum. The particular embodiment of the invention described herein is a drum brush chipper, which includes a drum with knives and the knives are rotated with rotation of the drum in circular sweeps past an adjacent cutter bar to produce chips from material. Typically, a brush chipper may be part of a movable vehicle, such as a towed trailer, and used by the operator to cut up brush, limbs, and other residues into chips for easy disposal.

For a chipper to operate properly, it is important that the cutting edges of the knives that produce the chips be sharp, and that these knives be precisely located on the drum of the chipper so as to protrude the exact required distance beyond the surface of the chipper drum. With a brush chipper which includes a cutter bar, which the cutting edges move adjacent during the chipping action, exact positioning of the knives results in the precise clearance desired between the cutting edges and the cutter bar to produce optimum chipping. In a conventional chipper, to produce a sharp cutting edge, a knife is removed from the chipper drum, sharpened, and then returned. Sharpening of a knife changes the location of the cutting edge with respect to the body of the knife. This requires that each knife that is removed from the chipper drum, and after sharpening, be remounted with care taken that the knife be repositioned to have the desired clearance. When it is remembered that most chipper drums have multiple knives, it becomes obvious that sharpening of knife edges, in addition to requiring skill and exactitude in the operator, is time-consuming, and is reflected in labor costs and down time in the chipper.

A general object of the invention is to provide an improved drum-type chipper with a unique construction for supporting a knife which facilitates replacement of an edge when needed.

Another object is to provide a chipper where the cutting edge in a knife is one of the edges of a precision-made, replaceable, double-edged knife. With dulling of an edge, a new edge is provided, either by turning over the knife to put its other edge in a cutting position, or by replacing the knife if both edges have been dulled.

Yet a further object is to provide a chipper which includes a knife mounting for supporting the knife with the knife mounting having means for precisely locating a knife, with respect to the mounting, and with the chipper drum which mounts the knife mounting having means which precisely locates the knife mounting on the drum.

With the organization described, a knife may be replaced, with the replacing knife having a cutting edge which is precisely located at a desired position, without the necessity of producing adjustments in the machine each time a replacement occurs.

BRIEF DESCRIPTION OF THE DRAWINGS

Various other objects and advantages are attained by the invention, which is described herein below in conjunction with the accompanying drawings, wherein.

DETAILED DESCRIPTION OF A PREFERRED EMBODIMENT

Figure 1:
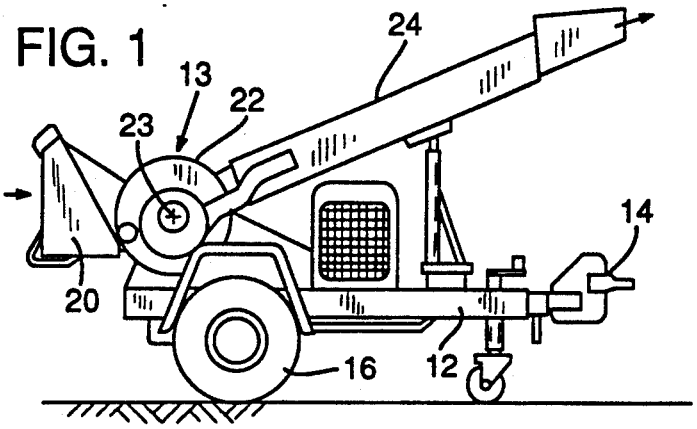
FIG. 1 is a view illustrating a drum brush chipper constructed pursuant to the invention.

Referring to the drawings, and first of all to FIG. 1, illustrated is a trailer 10 mounting a chipper 13, such as might be employed by tree surgeons, utility companies, park maintenance crews, etc., for the purpose of chipping up branches and tree growth, etc. to facilitate removal and disposal of this material. The chipper includes a trailer frame 12, with a hitch 14 to couple the frame to a drawing vehicle. Supporting the frame for movement over the ground are wheels, such as wheels 16.

The chipper further includes a hopper 20 provided to receive material fed into the chipper. A power-driven chipper drum rotatable within a casing 22 is rotated about axis 23 to produce chips of the material fed the apparatus. Chips produced are thrown outwardly through a chute 24 thence to be collected in a suitable manner as by collecting them in the body of a dump truck. Supported on the trailer frame is the usual internal combustion engine 26 which provides the power for rotating the drum of the chipper.

Figure 2:
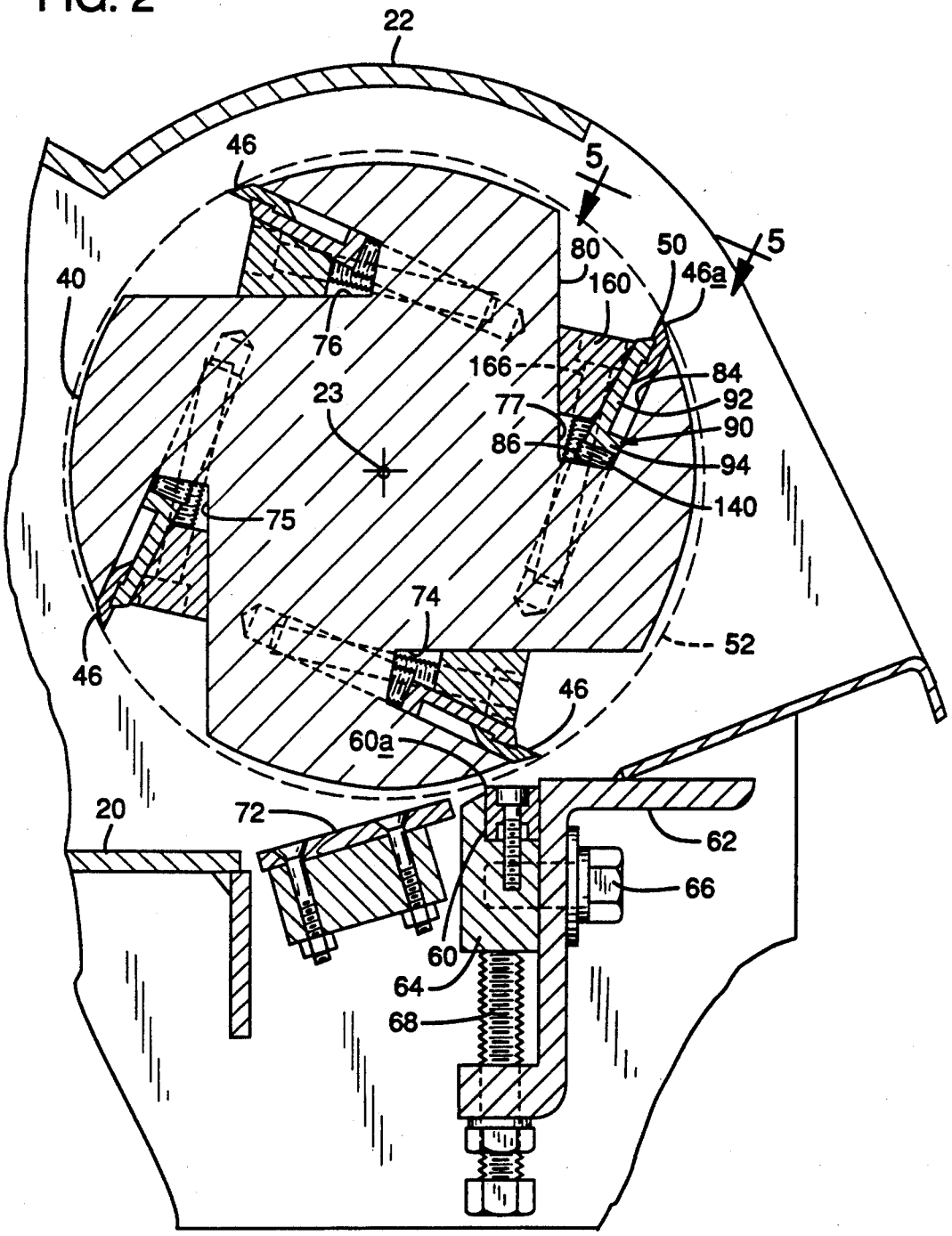
FIG. 2 is a cross-sectional view, on a larger scale than FIG. 1, illustrating a drum within the chipper and multiple knives supported on this drum.

Reference should now be had additionally to FIG. 2 which illustrates details of the chipper drum within the chipper apparatus, and associated structure whereby chips are produced with rotation of the drum.

A chipper drum provided within the chipper apparatus is indicated at 40. During operation of the chipper, the drum is rotated under power, about its axis 23, with operation of engine 26 earlier described. Equally distributed about the circumference of the drum are plural knives 46. As demonstrated by the knife **46*a*, each knife is supported with a cutting edge 50 in the knife disposed slightly outwardly of the drum circumference 44 and with this edge paralleling axis 23 of the drum. With rotation of the drum, the cutting edge moves in a cylindrical sweep, shown at 52**.

The chipper is provided adjacent the base of the drum, as such is illustrated in FIG. 2, with an elongate cutter bar 60 which extends substantially the length of the drum and is adjacent its periphery. Framework of the chipper is shown at 62. The cutter bar is mounted securely in a stationary position within the chipper by a pressure bar 64 which provides support for the cutter bar and which is secured to the framework of the chipper with fasteners as exemplified by fastener 66. Supporting the bottom of bar 64 are screw studs 68.

The hopper of the chipper is at the left in FIG. 2. Material fed the machine moves from the hopper onto a floor plate 72 attached to the framework of the machine.

With operation of the chipper, the drum is rotated in a counterclockwise direction as such is illustrated in FIG. 2. The path of the edges of the knives extends adjacent edge 60*a* of bar 60. There is a predetermined distance between this path and the edge, to produce optimum chip size and cutting operation. Proper operation of the chipper is also predicated on all of the knife edges moving in the same path.

This invention features the provision of replaceable, double-edged knives for the knives carried by the drum, and the provision of a knife mounting for each knife which is accurately adjustably positionable to have a predetermined location on the chipper drum. There is also provided means interposed between a knife mounting and a knife, which accurately and precisely establishes the position of the knife with respect to the knife mounting. With this organization, and with the employment of knives which are precision made and have dimensions which are consistent and uniform, it is possible to replace a knife, or to turn over a knife so that another of its edges is placed in operative position, without the need, when such is performed to make adjustments whereby knife edges have the desired protrusion beyond the drum surface.

Figure 3:
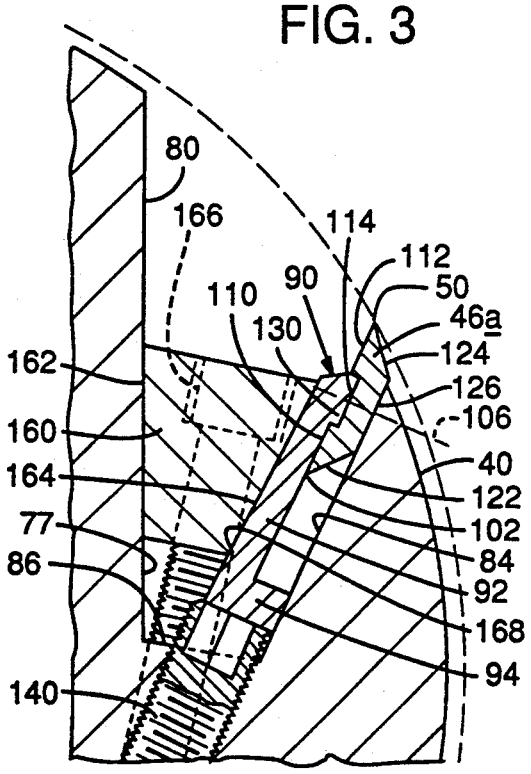
FIG. 3 is a view, illustrating positions of the drum shown in FIG. 2, but on a larger scale.
Figure 5:
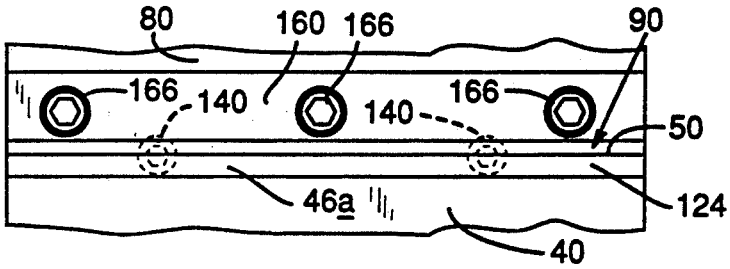
FIG. 5 is a view taken along the line 5—5 in FIG. 2.

Specifically, and referring to FIGS. 2, 3, and 5, the chipper drum is provided at points distributed about its circumference with multiple slots, indicated for the drum at 74,75, 76, and 77. The slots all have the same proportions and configuration, and each opens to the exterior of the drum. Each slot extends entirely the distance between the ends of the drum. Thus, and describing by way of illustration the dimensions of a typical drum, such might have a diameter of 18 inches and the length between the ends of 12 inches. Each slot, therefore, has a 12 inch length, sufficient whereby the slot extends completely between the ends of the drum.

Each slot is defined by a side wall 80 which is essentially planar, parallels the axis of the drum, and extends at an acute angle with respect to a radial plane in the drum passing through the line of joinder formed where surface 80 meets with the circumference of the drum. Also defining the slot is a wall 84 opposite wall 80 which is also planar, and which also parallels the axis of the drum. Wall 84 diverges from wall 80, progressing in a direction extending outwardly on the drum. The bottom of the slot is formed by wall 86.

Mounted within each slot is a knife holder 90. The knife holder is an elongate element extending essentially the length of the slot. Viewed from the end the holder has essentially an L-shaped configuration, formed by a web expanse 92 which joins at one end with a ledge portion 94. The knife holder resides within a slot, with the end of the ledge portion flat against wall 84 of the slot.

Considering the construction of a knife, preferably the knife is a double-edged knife, with an edge 102 opposite and parallel to edge 50, and the knife being symmetrical about a plane 106 which bisects the knife midway between these edges.

The front of the knife, which is the side facing slot wall 80, is formed by front knife surfaces 110, 112. Between these knife surfaces and extending the length of the knife is a key-receiving channel 114.

The back side of the knife is defined by a pair of back knife surfaces 122, 124, and these join with surfaces 110, 112 to form edges 102, 50. The back knife surfaces have substantially equal widths, and are planar, and are inclined at a common acute angle with respect to the plane of the front knife surfaces. Extending between and joining the back knife surfaces is a bearing surface 126.

The knife described may be a replaceable knife, and is precision made by the manufacturer to have measurements precisely duplicated in replacement knives. With such a knife precisely located on the knife holder, and with the knife holder precisely located in the slot, when a knife is replaced with another knife, or an edge is replaced by turning the knife around, this has little significant affect on the position of the edge where such protrudes beyond the circumference of the drum, and, in turn, the clearance of this edge with respect to the cutter bar when the knife is revolved with rotation of the drum.

Seating the knife on the knife holder is an elongate key 130 integral with the holder and extending along web expanse 92. This key snugly fits within the key-receiving channel 114. Mounted in this fashion, front knife surface 110 extends along and lies against an inner surface of web expanse 92.

A holder is positioned with respect to bottom wall 86 of the slot with knife height adjustment screws or abutments 140. A pair of such adjustment screws may be provided in each slot with one adjacent and inwardly from each end of the slot. Each is screwed into an accommodating threaded bore provided in the drum disk. Each screw which may have a recessed head socket portion adapted for engagement by a tool. The bottom of ledge portion 94 rests against the tops of screws 140.

A wedge bar 160 locks a knife holder firmly in place within a slot. The wedge bar has converging surfaces 162, 164 extending along its opposite sides. The wedge bar is drawn tightly inwardly into a slot through tightening of screws or fasteners 166.

Web expanse 92 has an outer surface 168 which contacts surface 164 on the wedge bar. Preferably, surface 168 does not exactly parallel wall 84 of the slot. Instead the surface diverges from this wall slightly progressing in a direction extending inwardly on the slot. As a consequence, and with relative outward movement of the knife holder with respect to the slot, as tends to occur under the action of centrifugal force, a wedging action is produced tending to increase the grip which the wedge bar exerts on the knife holder.

Describing the chipper, when initially setting up the chipper drum to accommodate the particular style of knife that is being utilized, knife height may be adjusted through appropriate turning of adjuster screws 140. This adjustment serves to locate the cutting edge of a knife as held by the knife holder within the slot.

When one of the edges of a knife becomes dull through use, it is a relatively simple matter to loosen a wedge bar to enable the knife to be removed and turned end for end, thus to replace the dulled edge with the opposite edge of the knife. With the knife then returned to a proper position, with the key of the knife holder seating within the key-receiving channel of the knife, the wedge bar is returned and the knife reclamped in place.

If it is desired completely to replace the knife, such is easily done after first loosening the wedge bar to permit withdrawal of the knife which is to be replaced. The replacing knife since it has the same dimensions as the knife replaced, is readily mounted with its key-receiving channel properly seated on the key of the knife holder.

With the procedure described, there is no need to make clearance measurements with respect to the knife edge of the knife, nor is there any need to make adjustments in the adjustment screws that serve to position the knife holder in the slot.

Figure 4:
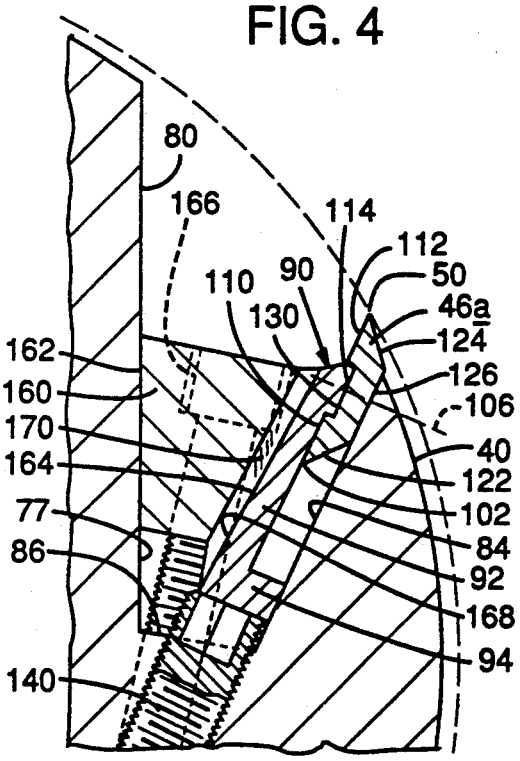
FIG. 4 is a view similar to of FIG. 3, but showing a modification the invention.

A modification of the invention is illustrated in FIG. 4. In the construction shown in FIG. 4, web expanse 92 of the knife holder is provided along that surface which faces slot wall 80 with an elongate rib 170. The rib seats within an accommodating groove provided in the surface of wedge bar 160. The groove and rib construction inhibits shifting of the knife holder relative to the wedge bar in a direction parallelling the axis of the drum.

The construction described obviously considerable speeds up the process of producing sharp edges in the knives of the drum chipper. This substantially reduces down time and maintenance costs.

While an embodiment of the invention has been described, obviously modifications and variations are possible without departing from the invention.

It is claimed and desired to secure by Letters Patent:

1. A chipper comprising:

a drum, a slot in the drum opening to the periphery of the drum, a first wall in the slot that extends outwardly on the slot towards the circumference of the drum, a knife holder mounted on the drum and guided for movement along said first wall in a path, adjustable positioning means interposed between the base of the slot and the knife holder determining the position of the holder in said path, a knife mounted on said knife holder and the knife having a cutting edge and the knife being positioned with said edge located beyond the circumference of the drum, and locking means for locking the knife holder in place against said positioning means, said locking means including a second wall in the slot opposite said first wall that converges on the first wall progressing inwardly on the drum, a wedge member movably supported by the second wall for movement toward the knife holder on moving inwardly on the drum, and a fastener securing the wedge member in place.

2. The chipper of claim 1, wherein said knife holder has a surface facing said second wall, and the wedge member is also movably supported by said surface, and said surface of the knife holder and said first wall converge on each other progressing outwardly on the drum.

3. The chipper of claim 1, which further includes structure interposed between the wedge member and knife holder locking the two from relative movement in a direction extending axially of the drum.

4. A chipper comprising:

a drum, a slot in the drum opening to the periphery of the drum, a first wall in the slot that extends outwardly on the slot toward the circumference of the drum, a knife guided for movement along said first wall, a knife holder mounting the knife and means interposed between the knife and knife holder establishing a predetermined relative position, adjustable positioning means interposed between the base of the slot and the knife holder determining the position of the holder, and locking means for locking the knife holder in place against said positioning means, said locking means including a second wall in the slot opposite said first wall, a wedge member movably supported by the second wall, said knife holder having a surface facing said second wall, said surface converging on said second wall progressing inwardly on the drum, said wedge member also being guided for movement by said surface and with movement inwardly on the drum wedging between said surface and said second wall.

5. The chipper of claim 4, wherein said surface of the holder and said first wall in the slot converge on each other progressing outwardly on the drum.

* * * * *